US007359287B2

(12) United States Patent
Baroche

(10) Patent No.: US 7,359,287 B2
(45) Date of Patent: Apr. 15, 2008

(54) WATCH WITH A CONTAINER

(76) Inventor: Jean-Michel Baroche, 15 avenue Stéphane Mallarmé, Paris (FR) F-75017

( * ) Notice: Subject to any disclaimer, the term of this patent is extended or adjusted under 35 U.S.C. 154(b) by 548 days.

(21) Appl. No.: 10/522,408

(22) PCT Filed: May 26, 2003

(86) PCT No.: PCT/FR03/01591

§ 371 (c)(1),
(2), (4) Date: Jan. 26, 2005

(87) PCT Pub. No.: WO03/100532

PCT Pub. Date: Dec. 4, 2003

(65) Prior Publication Data

US 2005/0195692 A1 Sep. 8, 2005

(30) Foreign Application Priority Data

May 27, 2002 (FR) ..... 02 06454

(51) Int. Cl.

| | |
|---|---|
| ***G04B 47/00*** | (2006.01) |
| ***G04B 27/00*** | (2006.01) |
| ***A45D 42/02*** | (2006.01) |
| ***B65D 43/26*** | (2006.01) |
| ***B65D 43/24*** | (2006.01) |

(52) U.S. Cl. ..... 368/10; 368/278; 132/294; 220/264; 220/831

(58) Field of Classification Search ..... 368/10, 368/88, 276, 278, 281; 132/293–300; 220/263–264, 220/831

See application file for complete search history.

(56) References Cited

U.S. PATENT DOCUMENTS

| | | | | |
|---|---|---|---|---|
| 2,601,158 | A * | 6/1952 | MacGillivary | 132/297 |
| 2,948,106 | A * | 8/1960 | Blumstein | 368/244 |
| 4,681,127 | A * | 7/1987 | Gueret | 132/301 |
| 5,344,037 | A * | 9/1994 | Favre | 220/264 |
| 5,384,756 | A * | 1/1995 | Pelosi | 368/281 |
| 6,002,651 | A * | 12/1999 | Baccaray | 368/10 |
| 6,345,627 | B1 * | 2/2002 | Petit | 132/293 |
| 6,532,970 | B2 * | 3/2003 | Phue | 132/296 |
| 6,618,328 | B1 * | 9/2003 | Ellner et al. | 368/88 |
| 6,940,785 | B2 * | 9/2005 | Ellner et al. | 368/88 |

FOREIGN PATENT DOCUMENTS

| | | | |
|---|---|---|---|
| CH | 276863 | * | 7/1951 |

* cited by examiner

*Primary Examiner*—Vit W Miska
(74) *Attorney, Agent, or Firm*—Equinox Protection

(57) ABSTRACT

The invention relates to a watch housing comprising a body made in two parts (2, 3), connected one to the other. The one of the two parts (2) guarantees the function of a watch whilst the second part (3), connected to the bracelet, comprises means for attachment of an interchangeable module (M). Said module (M) is extended by an elastic tongue (20) and security means are provided to ensure that the tongue (20) is supported on the first part (2) whilst subjecting the above to a permanent force maintaining the same in the open position.

19 Claims, 3 Drawing Sheets

WATCH WITH A CONTAINER

The present invention deals with a designed container-watch that can be used in numerous applications.

The invention is applicable generally, but not exclusively, to the design and production of a watch which could accept a small container module capable of holding various products such as, for example, perfume or cosmetic products in solid, doughy or spray formats.

In a general manner, it is a known fact that a modular multifunction watch has already been proposed which allows adding to the more traditional watch functions numerous additional functions as selected by the user.

Hence, French Patent No. 01 15331 describes a watch consisting of a main assembly of two articulated and interconnected parts, one part which provides the autonomous function of a watch, and the second part which connects also to the watch's bracelet, and which provides the capability to add a small additional container module.

Hence, this watch can be shown in two different states:

one state, closing position, showing the first part covering the second part, encompassing partially at least, the small incorporated container module, and the other state, opening position, showing the two parts separated in an angular manner and/or in translation one to another, in order to use and/or access the added container module.

In the execution method described in this Patent, the second part is shaped in order to delimit an area, cylindrical for example, opened in its top part and eventually in its bottom. This area is shaped in order to receive the added container module of complementary shape.

It has been found that this solution presents a number of inconveniences:

Due to manufacturing tolerances, the added container module is very often subject to small gap variations which generate a discomforting feeling to the watch user.

In the opening position, the angular position of the watch's top part is unstable. However, this first top part must be maintained in the open position in order to have access to the added container module.

When the added container module needs replacement, the user has the tendency to introduce at least one finger on the part which holds the container module's product.

The air tightness between the two parts of the watch is faulty, in a manner such that the cosmetic product has the tendency to leak outside of the container-watch and/or between the container and it's holder inside the watch, with the understanding that the intended locking mechanism between the two watch parts must be designed in order to ensure the smoothest operation.

The invention therefore has the specific goal to eliminate these inconveniences.

To that effect, this invention proposes an interchangeable added container module having an extended elastic edge which in its assembled position in the intended space, this elastic element would exert a permanent pressure on the first part in order to maintain its open state.

Advantageously, the two parts of the watch would be equipped with locking mechanisms actuated on these two subject parts when in the close position.

These locking mechanisms would preferably be designed in such a manner that when in the locking state, one of the parts would exert a tightness pressure on the other part at the circular holding surface level around the space intended to receive the added container module. The holding surface of one of two parts will be equipped with a tightness lining.

Preferably, this lining tightness would be interdependent with a peripheral border for the interchangeable container module. This solution presents therefore the advantage of acquiring tightness between the two parts of the watch and at the same time, between these two parts and the added container module with its receiving bay.

One other characteristic of the invention is that the added container module could have the shape of a recipient, cylindrical for example, open at the top face and showing two opposite sides extending one to each other at the surface level in order to create holding areas which would ease the handling of the added module without the user's fingers touching the product residing inside the module.

Means would be taken in order to secure the added module in the receiving bay and to facilitate its removal.

Various ways of execution of the invention will be described herein via examples but without limitations, and referring to the annexed figures in which.

Figure 1:
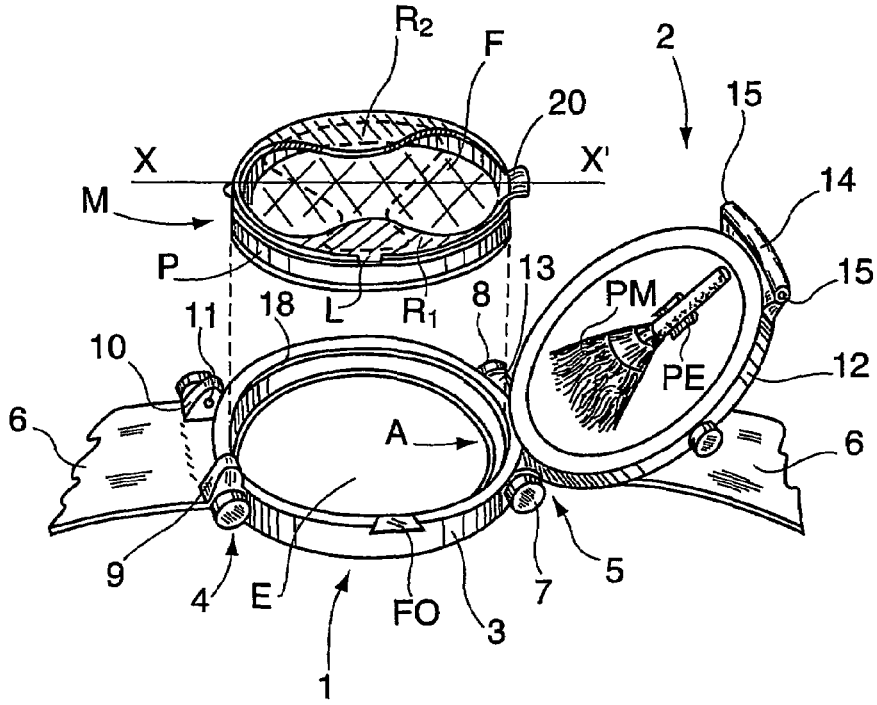
FIG. 1 is a perspective view of a container-watch as per the invention.

In the example shown at FIG. 1, the container-watch consists of a main assembly of two articulated and interconnected parts 1, 2.

The first part 1 consists of a ring-shaped wall 3, having fastening mechanisms 4, 5 which are diametrically opposed to each other as found on a traditional watch. At the level of fastening mechanism 5, the wall has two parallel protuberances 7, 8 which form an articulating arm A which extends in the perpendicular plane to the longitudinal axis of wall 3.

At the level of fastening mechanism 4, the wall 3 shows also two parallel protuberances 9, 10 which are each equipped with a retractable closing mechanism 11 in conjunction with elastic action ways.

The second part of the assembly consists of a circular 2 watch with a flat bottom 12 entirely autonomous. This watch 2 consists of two diametrically opposed locations, two protuberances of which:

an extended shaft 13 that is fixed on protuberances 7, 8 in order to ensure articulations of watch 12 on wall 3, an extended part, similar to extended part 13, but having two coaxial cavities 15, destined to snap between protuberances 9, 10 by retracting spur 11, the locking of the two parts being secured therefore by the engagement of spur 11 into cavities 15.

Cavities 15 are shaped in a manner that would ensure the unlocking of the two parts by exerting a rocking action on extended part 14 in order to put spur 11 in the release position.

Ring-shaped base 3 occupies a cylindrical space E open at the top level (and eventually at its bottom) in a manner which would accommodate the receipt of removable module M of corresponding cylindrical shape.

This removable module M consists of an external cylindrical-shaped case, open at its top level and closed at its lower level with a flat bottom F.

As per the invention, the top edge of cylindrical case P of the case contains an elastic flap 20, slightly curved, which extends axially in projection, in order to butt against the bottom of watch 2 by exerting a force in the opening direction of the watch.

Hence, when the watch 2 is folded and locked on wall 3, the flap 20 is being deformed elastically by accumulating potential energy. During the unlocking action, the flap 20, by releasing this potential energy, will engage the opening of the watch 2 by maintaining its open position. This flap 20 ensures also that the removable module is well kept in its space E.

Also, when the watch is in its closed position, the removable module M is firmly held in place by the exerting pressure from flap 20 and thus cannot moved around in its receiving bay E.

Of course, guiding means will be provided between the removable module M and wall 3 in such a manner that the engagement of module M into space E can only be carried out in a predetermined orientation for the module where the flap 20 would be positioned near articulation area A.

In this example, removable module M is expected to contain a cosmetic product in a solid, doughy or spray format. Therefore, in order to avoid, during the retrieval or the insertion of this module, that user fingers do not come into contact with the product, the top edge of the module's cylindrical wall P is prolonged in a radial fashion by two opposing edges R1, R2 located on the handling areas of module M.

In a way, these handling areas are symmetrically positioned in relation to a symmetrical axis XX' and passes thru flap 20. These areas have to coincide with two symmetrical zones of the ring base in relation to the longitudinal axis of the watch.

To facilitate its retrieval, the module has a protuberance L which extends in a radial manner towards the outside, starting from the top edge of its cylindrical wall, whereas the top level of the base cylindrical wall has a slanting notch FO located below the protuberance L when the module M is engaged in base 3. This protuberance L ensures proper guiding means.

Therefore, when the watch 2 is opened, it is possible to retrieve module M by introducing one's fingernail in notch FO and by exerting an upward pressure under protuberance L. Preferably, protuberance L and notch FO will be located under the watch's winder 2 when it is closed.

Beneficially, the bottom of the watch 2 could include an elastic peg PE in order to affix to it a removable make-up brush PM.

Alternatively, this brush PM could be affixed on the edges R1, R2 of module M. In this case, the bottom of the watch could be equipped with a mirror.

Module M could also be utilized as a powder box.

As previously outlined, an important challenge of this type of container-watch is that it needs to have good tightness between the two parts of the watch and also between the container and the subject two parts.

In order to solve this problem, the interposition of a tightness lining is required, and on the other hand, means of locking are also required when in the locked position, these exert an evenly distributed compression on the lining between the two parts of the watch.

FIGS. 2 to 9 show different solutions in order to solve this problem.

Figure 2:
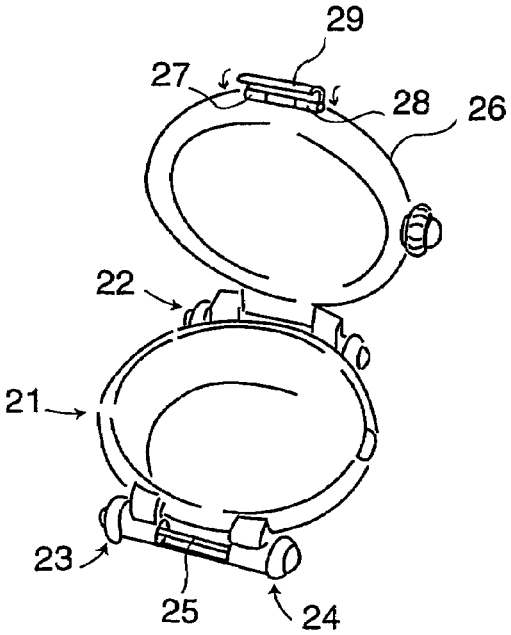
FIGS. 2 to 4 show a watch equipped with a pressure closing mechanism providing a tightness of the receptacle, in the open position (FIG. 2), in the closed position (FIG. 3) and in the locked position (FIG. 4)
Figure 3:
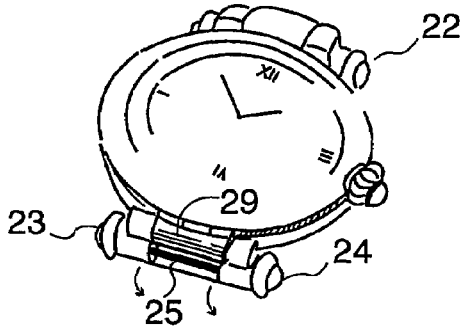
Figure 4:
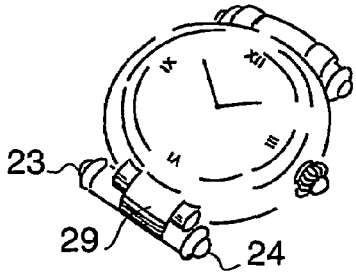

Therefore, in the illustrated example on FIGS. 2 and 3, the first part (base 21) consists, from the opposite side of the point of articulation 22, two parallel protuberances 23, 24 linked one to another via a hooking shaft 25.

The second part 26 consists, from the opposite side of the point of articulation 22 of base 21, two protuberances linked between themselves via an articulating axis around which is mounted a rotational flap 29 in a shape of a hook, intended to embrace the shaft 25 of base 21. Therefore, during the closing of the parts of the watch, the locking action is obtained by exerting a pressure on flap 29 which provokes its rocking and the engagement of its hook-shaped part on shaft 25. The pressure exerted during this closing action creates a compression of the tightness lining (resilient) via one of the two contact points between the two parts. The locking action obtained via flap 23 ensures the holding of this pressure. The unlocking is subsequently obtained by rocking flap 29 in the opposite direction by exerting a traction force via user's fingernail. This rocking motion results in disengagement of flap 29 and shaft 25.

Figure 5:
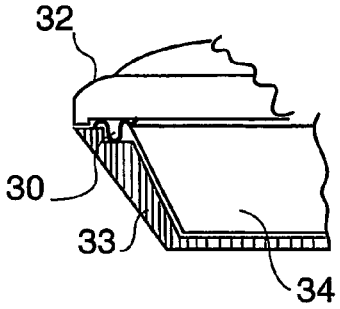
FIGS. 5 and 6 are partial axial cutout views of two watches of the type as previously described where the lining is found on the container.
Figure 6:
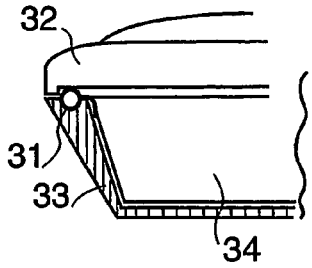
Figure 7:
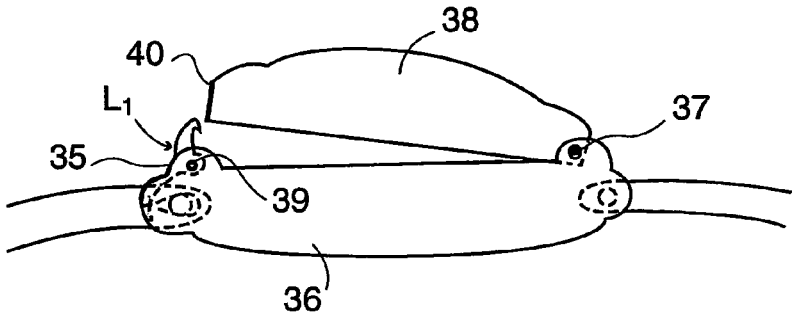
FIG. 7 is a schematic side view of a watch equipped with a hook closing mechanism.

In the example illustrated in FIGS. 5 and 6, lining 30, 31 is used to ensure the tightness between the two parts 32, 33 of the watch and container 34 is interdependent. The lining has a peripheral lip made of a resilient material that comes between the contact points of the two parts 32, 33. This lip can for example present a sinuous profile (FIG. 5) or consists of a round joint linked to the container via a membrane (FIG. 6). In both cases, the contact points could present an appropriate profile (including the buttress surface) in order to limit the crushing of lining 30, 31.

It is understood that the invention is not limited to the execution method of the locking mechanism as previously described.

Therefore, this mechanism could include a flap L1 rocking around axis 39 linked to the two protuberances 35 of base 36 located on the opposite side of articulation 37 on part 38 of the watch. This flap L1 consists of one part shaped as a hook on the side of axis 39 which is intended to interface with the edge 40 at the peripheral location of part 38 and, on the other side, part that acts as a lever. A spring (not shown here) acts on flap 35 in order to make it rotate and to bring the part shaped as a hook to interface with the edge 40. In this case, the locking action is automatically obtained at the end of closing run of part 38 on base 36. The tightness pressure is the result of the effort exerted on part 38 at the time of the snap-on of the hook on the edge 40.

Figure 8:
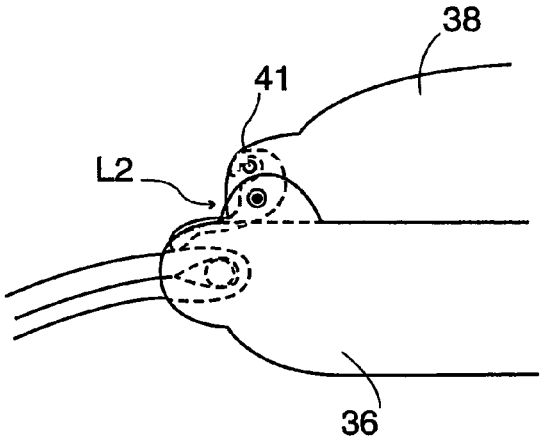
FIGS. 8 and 9 are partial side views of watches equipped with variations of the hook closing mechanism as shown at FIG. 7.
Figure 9:
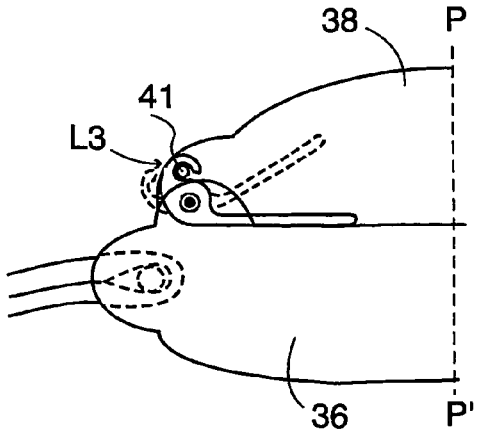
Figure 10:
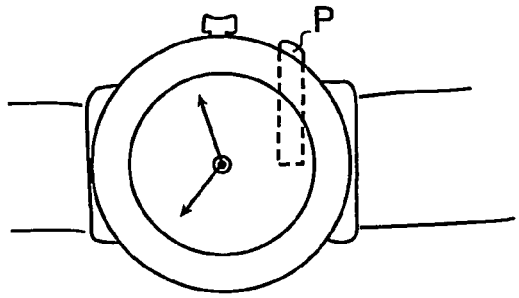
FIG. 10 is a schematic view of a watch equipped with an extractor for the container.
Figure 11:
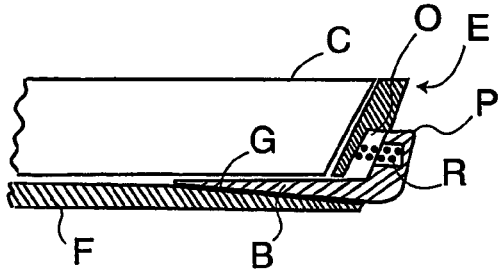
FIGS. 11 and 12 are partial schematic cutout views showing the concept of the extractor, in the resting position (FIG. 11), and in the extracting position (FIG. 12)
Figure 12:
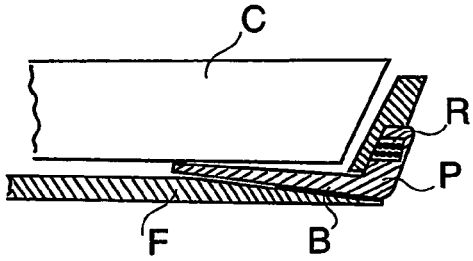

In the examples illustrated at FIGS. 8 and 9, the locking is ensured via lever L2 articulated on base 36 and consisting of one part in a hook shape intended to come in contact with shaft 41 (or rod) interdependent to watch part 38 to secure locking. This part shaped as a hook consists of a profile shaped cam conformed in order such that when engaged on shaft 41 or on the rod, the rocking of the lever L2 in the locking direction creates an applied force ensuring the tightness pressure. In the example of FIG. 8, lever L2 extends to the outside of the watch whereas on FIG. 9, lever L3 extends towards the central symmetrical plane of the watch (indicated as cutout P, P1).

Another problem addressed by the invention consists of the retrieval of the container. Indeed, in certain applications, measures foreseen in the execution mode at FIG. 1 prove to be insufficient in order to ensure adequate handling of the container. This is specifically the case when the container is found retained in its bay for example by snapping means.

To resolve this problem, the invention foresees an extractor which calls for a pushbutton P mounted in opening O found in the peripheral wall of base E, this pushbutton being interdependent with a brooch shaped as a wedge B which moves in slot G having a slightly slanted bottom (complementary to brooch B) created at the bottom F of base E.

Favorably, a spring R is foreseeing in order to push back pushbutton P towards the outside of base E, in a resting position.

Therefore, in the resting position, brooch B is entirely contained in slot G and container C can be totally engaged in base E.

To carry out the removal of the container one needs only to push on pushbutton P in order to create a sliding of brooch B in slot G. Due to the complementary nature of the slanted shapes, brooch B moves out from slot G and exerts a pressure on the bottom of container C which results in its removal. Container C can therefore be easily retrieved. The release of pushbutton P enables the automatic return to its resting position for another loading possibility at base E.

Figure 13:
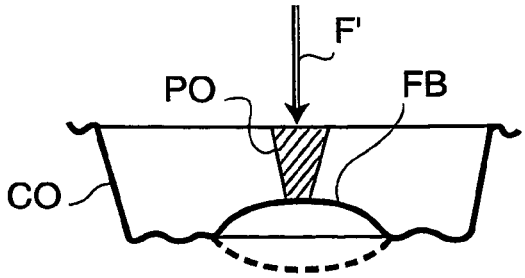
FIG. 13 is a schematic cutout view showing a variant of the extractor incorporated in the container.

Eventually, the extractor could be incorporated into the container. In this case, container CO could, for example, include as illustrated at FIG. 13, a dome-shaped bottom FB designed in such a way as to occupy two successive stable states, as follow:

- a first stable state where bottom FB presents a concave shape opened towards the outside. In this state, container CO occupies a minimal volume and could totally engage in the base of the watch.
- a second stable state where the bottom presents a projecting convex shape towards the outside. In this state, the container cannot be totally engaged in the base due to the convex shape (dashed lines).

The passage from the first state to the second state is obtained by exerting a pressure F' on the dome-shaped bottom's part, for example via a pushbutton PO foreseeing in container CO: due to this pressure F' the bottom FB moves abruptly from the first state to the second state and provoking the removal of container CO.

Figure 14:
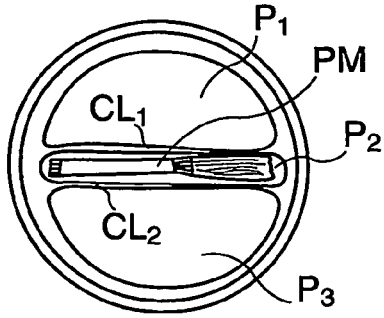
FIG. 14 is a top view of a variant of a container from the one of FIG. 1.

In the example illustrated at FIG. 14, the container is separated in three parts P1, P2, and P3 via two parallel partitions CL1, CL2 which extend from one another and at a small distance from the median symmetrical plane of the container.

These two partitions CL1, CL2, delimit between themselves an oblong volume which could be used to store an accessory such as, for example, a brush PM. Elastic means could therefore be incorporated to this storing area in order to provoke a partial removal of the accessory when opening the watch.

The invention claimed is:

1. Container-watch of the type having an assembly consisting of two parts (2, 3) articulated one to each other, one of the two parts (2) having means to ensure the function of a watch in an autonomous fashion, a removable and interchangeable added module (M), the second part (3), on which a bracelet (6) is attached, having means permitting the installation of the added module (M), having the characteristic that one of the edges of the added module (M) is extended with an elastic flap (20) associated with guiding means designed in such a manner that when in the assembled state and placed in the second part (3), the elastic flap (20) butts against the first part (2) by exerting on it a constant pressure which tends to maintain it in an open position.

2. Container-watch as in claim 1, characterized in that module (M) and subject second part (3) have the guiding means in order that the engagement of added module (M) in the second part (3) can only have one position for added module (M) in which flap (20) is located near the extremity of the intended articulation between the subject two parts (2, 3).

3. Container-watch as in claims 1 or 2, characterized in that the two watch parts (2, 3) are equipped with locking means triggered by the two parts in the close position.

4. Container-watch as in 1, characterized in that added module (M) presents the shape of a cylindrical recipient opened at its top level and showing two opposed edges (R1, R2) which extend one to each other at subject level in order to provide supports for adequate handling of added module (M) without having users' fingers touching the module's content.

5. Container-watch as in claim 4, characterized in that the module has one protuberance (L) which extends in a radial manner towards the outside, starting from a top edge of a cylindrical wall of the module, whereas the top part of a cylindrical wall of the second part consists of a slanted notch (FO) located under protuberance (L) when module (M) is engaged in the second part (3).

6. Container-watch as in claim 5, characterized in that protuberance (L) and notch (FO) are located under a winder of the watch (2) when closed.

7. Container-watch as in claim 1, characterized in that the bottom of the watch (2) includes an elastic peg (PE) in order to affix to it a removable make-up brush (PM).

8. Container-watch as in claim 1, characterized in that the module constitutes a powder box and that it includes a brush (PM) that is removable and is installed on the edges (R1, R2) of the module.

9. Container-watch as in claim 1 , characterized in that it includes locking means of the two parts in the closed position, these locking means being designed in such a manner that when in the locking state, one of the two parts exerts on the other a tightness pressure for a lining (30, 31) installed on a circular holding surface around the space used to accommodate the added module.

10. Container-watch as in claim 9, characterized in that the tightness lining (30, 31) is interdependent with a peripheral border of added module.

11. Container-watch as in claim 10, characterized in that the subject lining (30, 31) presents a sinuous shape or consists of a round joint linked to the subject peripheral border via a membrane.

12. Container-watch as in claim 9, characterized in that the subject locking means include a flap (L1) rocking around an interdependent axis to one of the parts , this flap (L1) consisting of one part shaped as a hook intended to interface with hooking means (40) on the other part and, on the other side, one part serving as a lever.

13. Container-watch as in claim 12, characterized in that the subject flap (L1) comprises elastic means.

14. Container-watch as in claim 9, characterized in that the subject locking means consist of a lever (L2, L3) articulated on one of the parts consisting of a base and including a hook shaped part intended to come into contact with a shaft or a rod (41) interdependent to the other part which constitutes the watch, this part having the shape of a hook with a cam profile conformed in such a way that during its engagement on shaft (41) or rod, the rocking of the lever (L2, L3) in the locking direction provokes the application of a force which ensures pressure tightness.

15. Container-watch as in claim 1, characterized in that it includes an extractor consisting of a pushbutton (P) mounted in an opening (0) found in a peripheral wall (E) of the second part, this pushbutton being interdependent with a slanted-shaped brooch (B) that moves in slot (G) designed at the bottom (F) of the second part.

16. Container-watch as in claim 15, characterized in that it includes a spring (R) required bringing back the pushbutton to its resting position, a position in which the brooch is seated in the slot.

17. Container-watch as in anyone of claim 1, characterized in that the added module comprises a container (CO) which consists of a dome-shaped bottom (FB) used as an extractor, this dome-shaped bottom representing a first stable state in which its concavity opens towards the outside and a second stable state in which it presents a projecting convex shape towards the outside.

18. Container-watch as in claim 1, characterized in that the added module comprises a container which is separated in three parts (P1 to P3) by two parallel partitions (CL1, CL2) which extend from one another and at small distance from a median symmetrical plane of the container, these two partitions delimiting between themselves an oblong volume which is used to store an accessory such as a brush (PM).

19. Container-watch as in claim 18, characterized in that elastic means are incorporated in space accommodating the added module in order to provoke a partial retrieval of subject accessory during the opening of the watch.

* * * * *